US007128236B2

(12) United States Patent
Presutti et al.

(10) Patent No.: US 7,128,236 B2
(45) **Date of Patent: *Oct. 31, 2006**

(54) VERSATILE LABEL SHEET AND DISPENSER

(75) Inventors: Stephen Presutti, Akron, OH (US); Wallace R. Fischer, Amesville, OH (US); Bryan Pittman, Alliance, OH (US); Bradley Borne, Uniontown, OH (US); Douglas W. Wilson, San Dimas, CA (US); Anahit Tataryan, Temple City, CA (US)

(73) Assignee: Avery Dennison Corporation, Pasadena, CA (US)

( * ) Notice: Subject to any disclaimer, the term of this patent is extended or adjusted under 35 U.S.C. 154(b) by 463 days.

This patent is subject to a terminal disclaimer.

(21) Appl. No.: 10/243,888

(22) Filed: Sep. 13, 2002

(65) Prior Publication Data

US 2004/0050854 A1 Mar. 18, 2004

(51) Int. Cl.
*B65H 5/28* (2006.01)
*G07F 11/68* (2006.01)

(52) U.S. Cl. ..... 221/73; 221/71; 221/72

(58) Field of Classification Search ..... 221/73, 221/72, 71

See application file for complete search history.

(56) References Cited

U.S. PATENT DOCUMENTS

| | | | | |
|---|---|---|---|---|
| 1,210,465 | A | | 1/1917 | Gubelman |
| 2,029,979 | A | | 2/1936 | Bernheim |
| 2,357,456 | A | | 9/1944 | Bryce |
| 2,802,598 | A | | 8/1957 | Petterson |
| 3,169,895 | A | | 2/1965 | Sohn |
| 3,537,933 | A | | 11/1970 | Severance |
| 3,676,257 | A | | 7/1972 | Ingalls |
| 3,886,032 | A | * | 5/1975 | Artelt, Jr. ..... 156/521 |
| 3,941,278 | A | | 3/1976 | Oglander et al. |
| 3,987,931 | A | | 10/1976 | Fell et al. |
| 4,059,203 | A | | 11/1977 | Wright |
| 4,060,236 | A | | 11/1977 | Carsteit |
| 4,082,595 | A | | 4/1978 | Slater |
| 4,426,898 | A | * | 1/1984 | Friberg ..... 83/37 |
| 4,757,348 | A | | 7/1988 | Rourke et al. |
| 4,791,451 | A | | 12/1988 | Hirose et al. |
| 4,872,593 | A | * | 10/1989 | Behringer ..... 221/231 |
| 4,939,674 | A | | 7/1990 | Price et al. |
| 5,053,814 | A | | 10/1991 | Takano et al. |
| 5,065,896 | A | * | 11/1991 | Jurgich ..... 221/73 |
| 5,067,835 | A | | 11/1991 | Yamamoto et al. |

(Continued)

*Primary Examiner*—Gene O. Crawford
*Assistant Examiner*—Michael Butler
(74) *Attorney, Agent, or Firm*—Law Office of Joel D. Voelzke

(57) ABSTRACT

A label sheet assembly is provided with bar code information thereon defining the layout of the labels on the backing sheet. A versatile label dispenser apparatus advances the label sheets and deflects them over a peeling bar in one direction to partially separate the labels from the backing sheet; with the advancing action being determined by the bar code information. The label sheet assemblies are then deflected in the opposite direction, and are routed in a substantially flat condition to the output of the dispenser apparatus. The labels are partially dispensed, substantially vertically from the dispenser, and a substantial number of sensors are provided to sense when all of the labels have been removed; and then the dispenser advances the label sheet assembly to partially dispense the next row of labels. The bar code reader may also sense the leading edge of the label sheet assembly to accurately control the incremental advancing of the label sheet assembly.

13 Claims, 11 Drawing Sheets

U.S. PATENT DOCUMENTS 5,131,648 A 7/1992 Ito
5,141,572 A 8/1992 Gerber
5,146,070 A 9/1992 Toma
5,201,514 A 4/1993 Rebres
5,209,374 A 5/1993 Seidl-Lichthardt
5,237,381 A 8/1993 Hamada
5,263,129 A 11/1993 Ikegaya et al.
5,346,202 A 9/1994 Jurkewitz
5,378,301 A * 1/1995 Boreali et al. ..... 156/344
5,392,106 A 2/1995 Bigenwald et al.
5,414,503 A 5/1995 Siegel et al.
5,449,090 A * 9/1995 Rodriguez ..... 221/73
5,478,159 A 12/1995 Schneider et al.
5,483,889 A 1/1996 Hoberock et al.
5,531,532 A 7/1996 Umbach
5,534,890 A 7/1996 Krug et al.
5,540,795 A * 7/1996 Franklin et al. ..... 156/64
5,542,769 A 8/1996 Schneider et al.
5,547,293 A 8/1996 Koch et al.
5,559,547 A 9/1996 Hagar
5,565,971 A 10/1996 Kuo et al.
5,608,443 A 3/1997 Palmer et al.
5,621,864 A 4/1997 Benade et al.
5,657,066 A 8/1997 Adams et al.
5,672,018 A 9/1997 Yamamoto et al.
5,684,931 A * 11/1997 Hagar ..... 358/1.8
5,690,329 A 11/1997 Van Peteghem et al.
5,789,727 A 8/1998 Teradaira et al.
5,790,162 A 8/1998 Adams et al.
5,816,721 A 10/1998 Palmer et al.
5,853,255 A * 12/1998 Soshi et al. ..... 400/237
5,855,395 A * 1/1999 Foote et al. ..... 283/67
5,872,585 A 2/1999 Donato et al.
5,874,980 A 2/1999 West
5,909,233 A 6/1999 Hamman et al.
5,947,467 A 9/1999 Billings et al.
5,978,004 A * 11/1999 Ehrhardt ..... 347/171
5,980,140 A 11/1999 Gutsell et al.
5,995,128 A 11/1999 Adams et al.
6,000,866 A 12/1999 Funaki et al.
6,020,906 A 2/2000 Adams et al.
6,024,355 A 2/2000 Hidding et al.
6,034,708 A 3/2000 Adams et al.
6,057,870 A 5/2000 Monnier et al.
6,151,037 A 11/2000 Kaufman et al.
6,199,765 B1 3/2001 Uhling
6,199,859 B1 3/2001 Schauer et al.
6,213,343 B1 * 4/2001 Damikolas ..... 221/25
6,246,776 B1 6/2001 Merz et al.
6,246,860 B1 6/2001 Ohmichi
6,254,952 B1 * 7/2001 Fox et al. ..... 428/40.1
6,335,084 B1 1/2002 Biegelsen et al.
6,338,481 B1 1/2002 Maruchi
6,380,965 B1 4/2002 Sims et al.
6,439,289 B1 * 8/2002 Schlotthauer ..... 156/539
6,805,184 B1 * 10/2004 Hsiu-Man ..... 156/584
2004/0050497 A1 * 3/2004 Presutti et al. ..... 156/349

* cited by examiner

VERSATILE LABEL SHEET AND DISPENSER

FIELD OF THE INVENTION

This invention relates to label dispensers and label sheets for use in label dispensers.

BACKGROUND OF THE INVENTION

Labels are normally supplied as a two layer sheet, with a face stock layer from which the labels are die cut, a layer of pressure sensitive adhesive, and a release coated backing layer or liner, from which the labels are dispensed. One widely used label sheet includes three columns of 10 labels each, for address labels, but many other sizes of labels are also available in sheet form.

In the manual removal of labels from a backing sheet; the user must try to grip a corner of the label and then peel the label from the backing sheet. This is often frustrating and time consuming. To simplify the separation of labels from a backing sheet, label dispensers have been proposed, and one such dispenser is disclosed in U.S. Pat. No. 5,209,374. In this dispenser, sheets of labels are drawn over a "peeling" bar and, by abruptly changing the direction of feeding of the sheets, the labels are separated from the backing sheet and are held by one edge, with the labels extending horizontally from the backing sheet so that they may be gripped and removed by the user.

However, while the apparatus of the U.S. Pat. No. 5,209,374 patent is a significant improvement over manual removal of labels, it still has certain shortcomings. Thus, for example, the liner sheets are stressed as they are bent over the "peeling" bar, and form fairly tight curled cylinders as they exit from the label dispenser. In addition, this known dispenser is not very flexible in accommodating different types of label sheets, or variations in the use of the label dispenser.

SUMMARY OF THE INVENTION

Accordingly, principal objects of the invention are to overcome the problems outlined above, and to provide a user friendly, versatile label dispenser and associated label sheets.

In accordance with one aspect of the invention, therefore, a label dispenser has an input tray or label sheet holding arrangement, and a "peeling" blade for partially separating the labels from the backing sheet or liner by abruptly changing the direction of feeding of the label sheets, while concurrently stressing the liner sheet and introducing a curl in one direction into the liner sheets. The liner sheets are then routed through a further paper path to stress them in the opposite direction, and they are then deposited flat into an output receptacle or tray. Accordingly, instead of a series of waste rolls requiring special disposal, the flat output liner sheets are compact and easily handled.

Another feature involves the inclusion of a plurality of sensors, preferably equal to the maximum number of columns of labels on a label sheet, so that the dispenser will not advance the label sheets until all labels in a row of partially dispensed labels have been removed. Alternatively, sensors may be provided at the location of the last labels to the right and to the left, so that the dispenser senses when both of these end labels have been removed, and then advances the label sheet.

As an additional feature of the invention, the label sheets are preferably provided with a code identifying the label sheet and/or providing coded information, including any or all of the following: (1) the size of the label, (2) the number of rows of labels, (3) the number of columns of labels, (4) the size of any matrix or residual facestock between labels, and (5) the size of the top margin of the label sheet or the distance from the leading edge of the sheet to the first label; and the label dispenser senses this code and advances the label sheet by distances corresponding to the sensed information. Additional information such as label sheet size, may also be provided. In the event that no coded information is provided on the label sheet the sheets may be fed through the label dispenser without dispensing labels. In some cases the dispenser may be programmed to operate with only 8½×11 inch sheets, or with A-4 size sheets, and advance the sheets based on operation only with sheets of one of these sizes.

In one preferred embodiment the bar code includes (1) the height of the labels, (2) the distance from the edge of the paper to the first label, and (3) the matrix or face stock distance between labels.

In accordance with one illustrative embodiment of the invention, a dispenser for labels mounted on a backing sheet or like, includes a label sheet feeding apparatus, a peeling blade for separating the labels from the backing sheet, a movable sweep bar for selectively deflecting the backing sheet abruptly over the peeling blade in a predetermined direction, with the labels being dispensed to extend substantially vertically, an input tray for holding a stack of label sheets directed downwardly toward the sheet feeding apparatus, a decurling structure for bending the sheets in a direction opposite from the predetermined direction, and an output tray adjacent the input tray for receiving used substantially flat backing sheets.

The label dispenser may also include a reversible motor for opening and closing the sweep bar as the motor operates in opposite directions; and this motor may also actuate feed rollers for advancing the label sheets through the dispenser in predetermined steps. A second motor may be provided to actuate an input sheet "picker" assembly and for initial advancing of the label sheets. The motors are preferably stepper motors, and are energized to operate in accordance with the information provided by the codes on each label sheet, and sensors included in this dispenser.

Optical sensors may be provided to both sense the coded information on the label sheet assemblies, and also for sensing the edges of said label sheets, providing inputs, which with the coded information from each sheet, controls the sweep bar actuation and the feed distances. These sensors may be in the form of light emitting diodes (LEDs) and phototransistors; and they may operate with the LED and phototransistors on opposite sides of the labels or the sheet assemblies, or may both be on the same side, and responding to reflected light.

Additional mechanical features may include one or more of the following:

1. Over-riding or unidirectional clutches to separate mechanical actions for the first motor operating in the forward and reverse modes.

2. Over-center positive snap action for the sweep bar.

3. The use of one cam and cam follower for opening the sweep bar when the reversible motor is operating in one direction, and another cam and cam follower for closing the sweep bar when the reversible motor is operating in the other direction. The over-riding or unidirectional clutches may be coupled into the cam structures to implement the actuation of only one cam for each direction of rotation of the reversible motor.

4. An input sheet picker release lever and mechanism to provide increased picker sheet feeding reliability.

5. In the event that a meaningful bar code is not read by the dispenser bar code sensors, the sheet may be continuously fed through the dispenser, and ejected from the top of the dispenser, without actuation of the sweep bar.

Other objects, features and advantages of the invention will become apparent from a consideration of the following detailed description and from the accompanying drawings.

DETAILED DESCRIPTION OF THE PREFERRED EMBODIMENTS

While the specification describes particular embodiments of the present invention, those of ordinary skill can devise variations of the present invention without departing from the inventive concepts.

Figure 1:
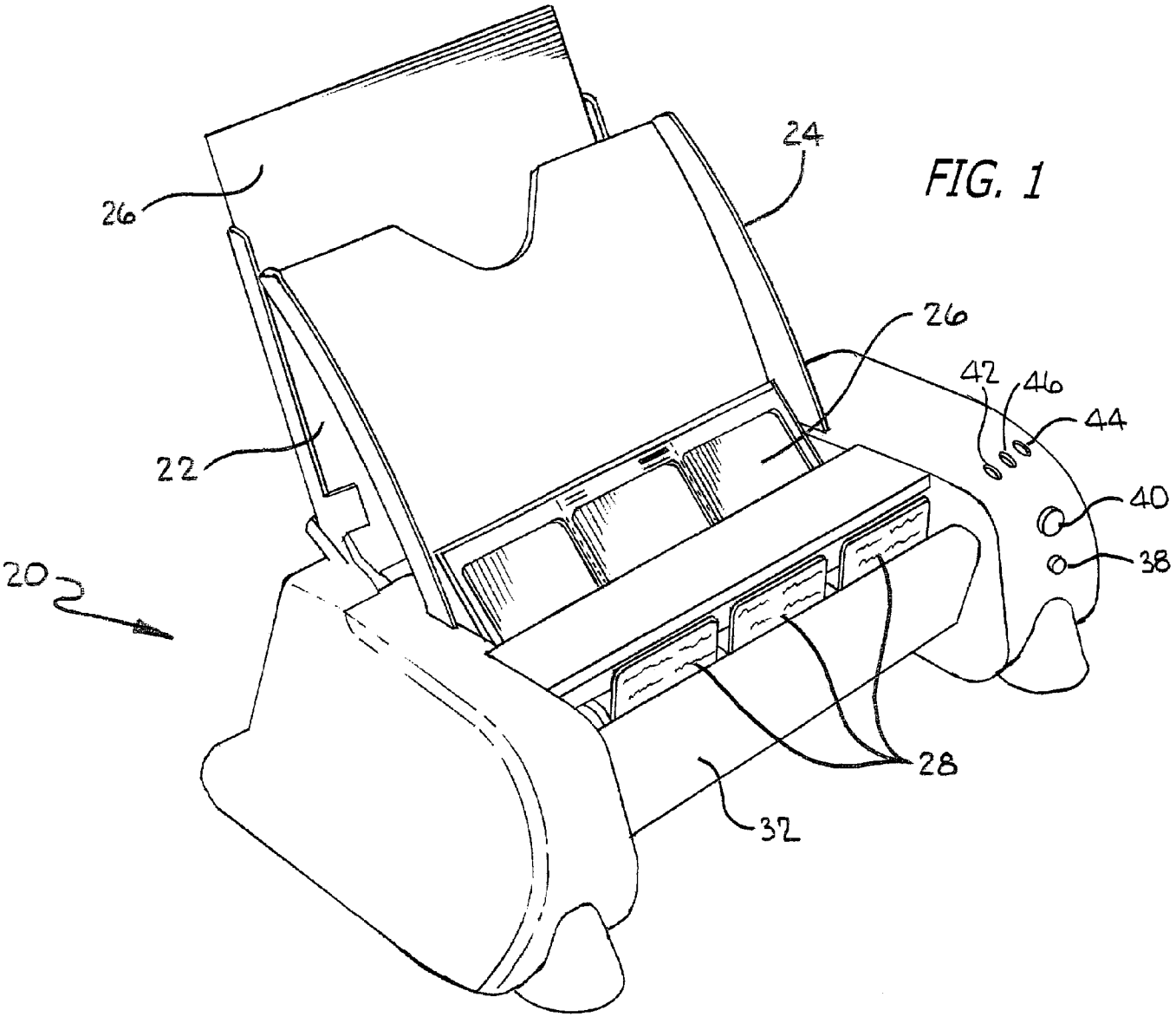
FIG. 1 is a perspective view of a label dispenser illustrating the principles of the invention and showing one label sheet with three labels partially dispensed from the label sheet and extending upward, substantially vertically.

Referring now to FIG. 1 of the drawings, the label dispenser 20 includes two trays 22 and 24, with tray 22 holding a stack of label sheets 26 with the back of the label sheet assemblies facing forward. The second tray 24, which is mounted in front of the tray 22, receives the backing sheets or liners 26 after the labels 28 have been removed.

It may be noted that the labels 28 have been partially separated from the backing sheet 26, and protrude upwardly from the label dispenser so that the user may grip the labels easily, pulling them from the backing sheet and applying them to an envelope or other location where the labels are to be used.

Figure 2:
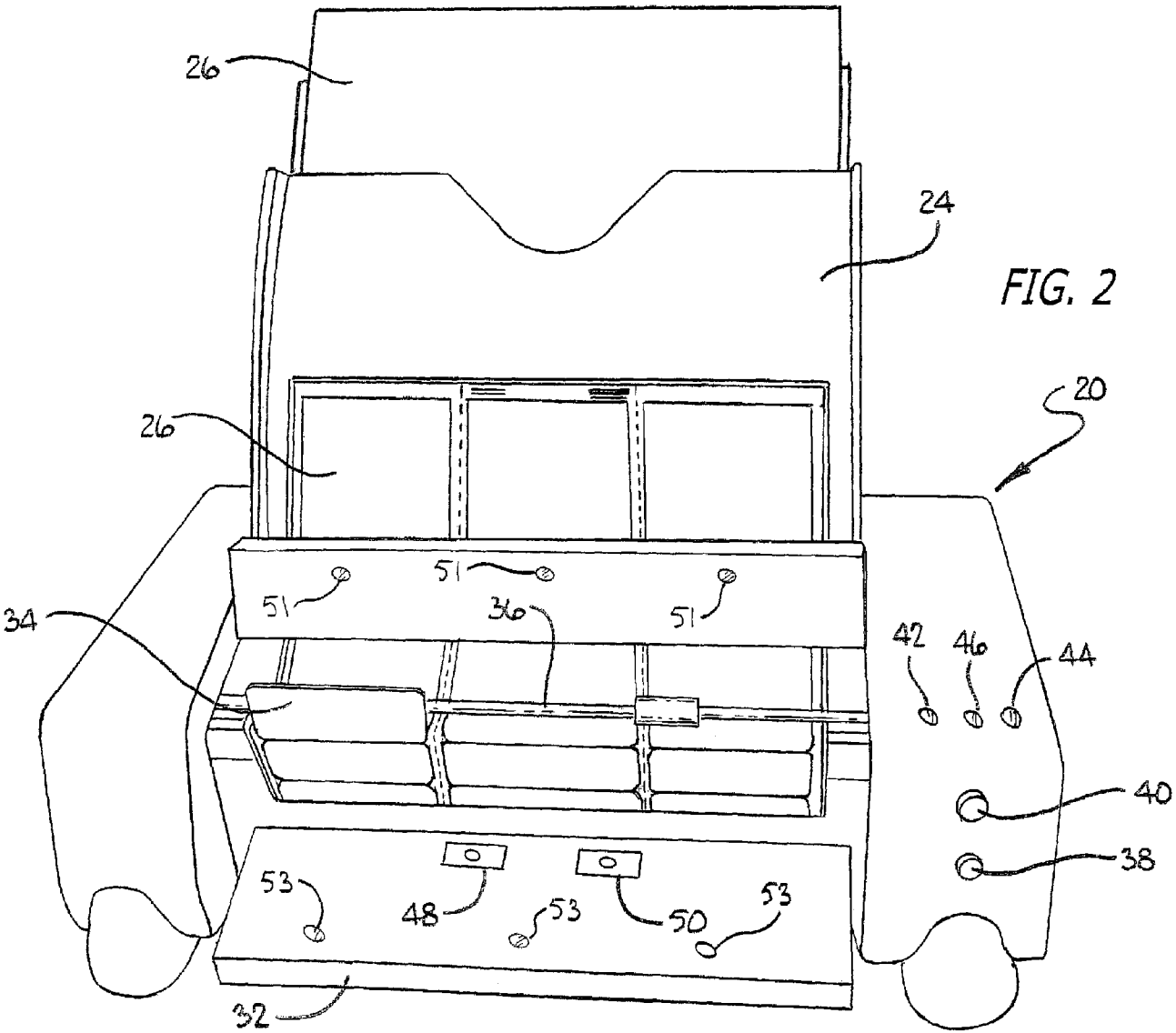
FIG. 2 is a frontal view of the label dispenser of FIG. 1 with the front closure of the apparatus being opened and with the sweep bar being visible.

Referring now to FIG. 2 of the drawings, it is a straight on view from the front of the apparatus, with the front cover or panel 32 being folded forward to expose the inside of the dispenser unit. In the showing of FIG. 2, two of the three labels in the top partially dispensed row of labels have been removed, and label 34 is still available for the user to remove and apply to the desired location. Also appearing to advantage in FIG. 2 is the sweep bar 36 which deflects the backing sheet or liner over a "peeling" bar which will be shown and discussed hereinbelow. To the right in FIG. 2 are shown the control and signal lights of the dispenser. Initially, the on/reset switch 38 is provided, and the switch 40 is included for ejecting the label sheet assembly from the apparatus when it is desired to change the type of label sheet being fed, or for other similar reasons.

Three signal lights are provided, and they include the green on/off signal light 42, the red signal light 44 indicating a paper path jam or malfunction, and the yellow signal light 46 indicating that the particular label sheet supplied from the input tray 22 was not recognized by the dispenser. Under these conditions, the sweep bar is not actuated, and the label sheet assembly is passed through the dispenser and out the top of the dispenser, without removing any labels.

Mounted on the inside of the front panel 32 are two units 48 and 50, each including a light emitting diode (LED) and a photo transistor, for reading bar code information which is included adjacent the leading edge of each label sheet assembly. The light emitting diodes direct light toward the label sheet assembly, and the phototransistors are oriented to sense reflected light, thereby sensing the presence of the label sheet, and the bar code. The coded indicia on the bar code on the label sheets may include some or all the information mentioned hereinabove, i.e., (1) the size of the label, (2) the number of rows of labels, (3) the number of columns of labels, (4) the size of any matrix between the labels, and (5) the size of the top margin of the label sheet or any subset of this information. Other information, such as the sheet size, for example, may also be provided. This information is transmitted to the microprocessor included in the dispenser, and the sheet is fed through the dispenser using the information provided by the bar codes, and the sensors.

In order to sense the presence of the labels 28 as identified in FIG. 1 or the label 34 identified in FIG. 2, a plurality of light emitting diodes 51 are provided, with a corresponding set of phototransistors 53 also being provided to provide signals indicating the presence of the labels 28 or 34. When the front cover 32 is closed, the phototransistors 53 are positioned to sense light from the LEDs 51. As the labels are pulled out of the dispenser, the user usually pulls the labels from left to right, or right to left, so the two end sensors 51–53 are normally adequate. However to insure that all of the labels have been removed, it is desirable to have three pairs of sensors, and more may be provided to insure coverage when smaller labels in more columns are to be considered.

It is also noted that the phototransistors could be mounted adjacent the LEDs to sense change in reflected light when the labels are present as compared to the received illumination when labels are not present.

Figure 3:
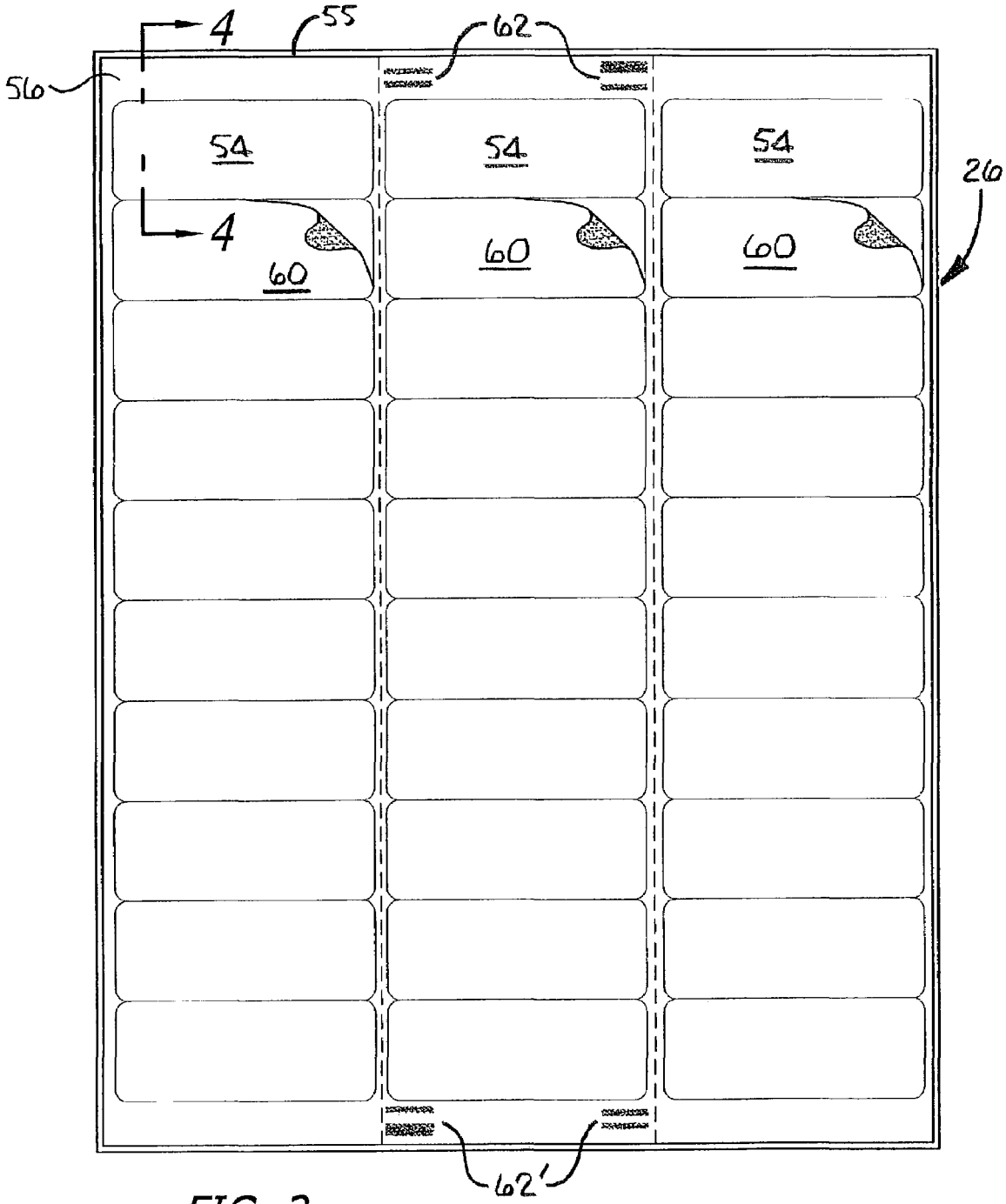
FIG. 3 is a plan view of a label sheet including three columns of labels, and with coded information on the label sheet identifying its configuration.
Figure 4:
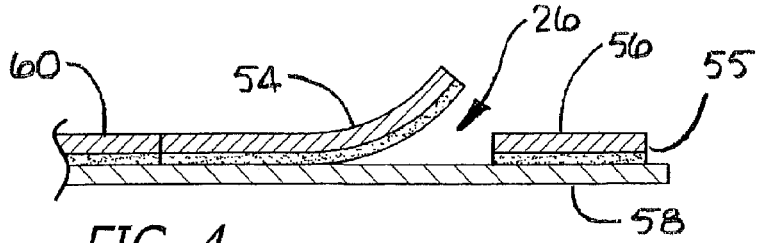
FIG. 4 is a cross-sectional view taken along lines 4—4 of FIG. 3.

Referring now to FIGS. 3 and 4 of the drawings, a label sheet assembly 26 is shown with the one row of three labels 60 being shown bent up to indicate how the labels could be manually removed from the backing sheet. FIG. 4 is a partial cross-sectional view along lines 4—4 of FIG. 3. In FIG. 4 the initial edge 55 of the sheet is shown with the face stock material 56 still adhered to the liner portion 58 of the label sheet assembly 26. The beginning of a label 60 which forms part of the second row of labels, is also shown in FIG. 4. As can be seen in FIG. 4, as well as in FIG. 3, the labels in successive rows abut one another and there is no vertical space between labels. In some label sheet assemblies, however, the labels are spaced slightly apart on the face stock and there is some residual face stock known as "matrix" which remains adhered to the backing sheet or liner 58 after the labels have been removed. Information relating to this intermediate matrix or the lack thereof, is provided by the bar codes 62, along with additional information as mentioned elsewhere in this specification.

Figure 5:
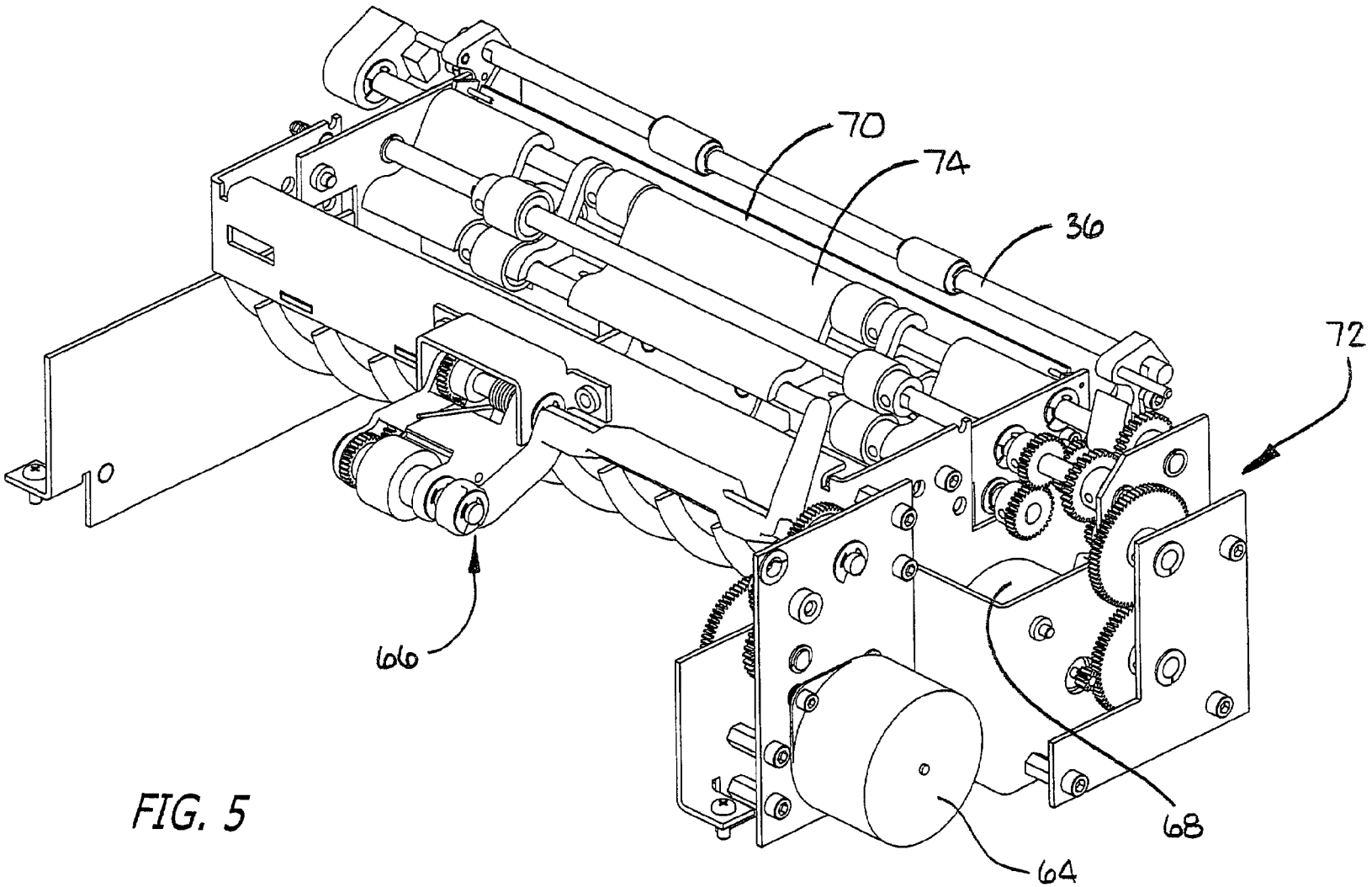
FIG. 5 is an isometric view of the label dispenser with the outer housing and label sheet trays being removed, taken from the rear and from the side of the unit upon which the two motors are mounted.

Referring now to FIG. 5 of the drawings, it is an isometric view from the rear and from the side of the dispenser where the motors are located. In addition, as mentioned above, the dispenser housing has been removed. Concerning the motors in the label dispenser, the motor 64 may be a stepper motor which operates the "picker" construction 66 which engages the top sheet from the stack of label sheet assemblies in the input tray 22 and feeds it forward into the dispenser mechanism. The stepper motor 64 also serves to rotate at least one additional shaft carrying rollers which advance the label sheet assembly through the dispenser. The second motor 68 is only partially visible in FIG. 5. It may also be a stepper motor, and is reversible to control the movement of the sweep bar 36 from the open position as shown in FIG. 5 to a closed position where the liner or backing sheet 58 (see FIG. 4) is bent over a peeling bar 70 to partially dispense the labels. The gear reduction construction indicated at reference numeral 72 serves to couple the output from the stepper motor 68 to the various shafts which pull the liner through the dispenser and out to the tray 24 as shown in FIGS. 1 and 2 of the drawings. The guide member 74 directs the liner through the apparatus and assists in the "decurling" step which is helpful in flattening the liner and permitting easy storage of the waste liners in the output tray 24.

Figure 6:
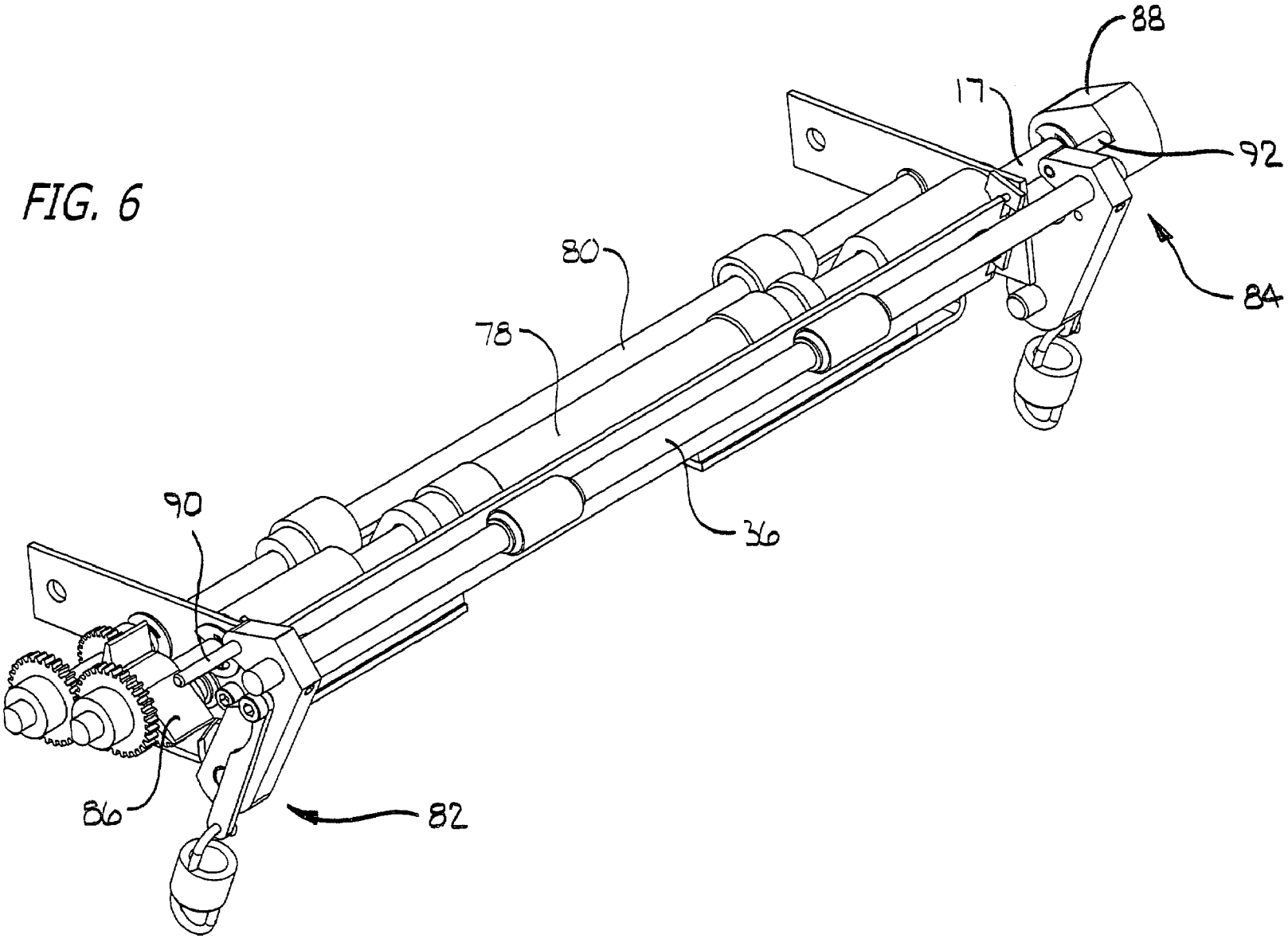
FIG. 6 is a perspective view of the movable sweep bar which separates the labels from the backing sheet, and the immediately associated mechanical construction.

Referring now to FIG. 6 of the drawings, it is an isometric view of a subassembly including the sweep bar 36 and additional feed rollers 78 and 80. The sweep bar 36 has two stable positions controlled by the over center action mechanisms 82 and 84, one of which will be described in greater detail hereinbelow. Generally, in FIG. 6, the sweep bar 36 is shown in the open position, ready to receive a new label sheet assembly. Its movement toward and away from the roller 78 is controlled by the cams 86 and 88 which engage the cam followers 90 and 92, respectively, with the cams being operated by the motor 68 as it is operated either in the forward or reverse directions.

Figure 7:
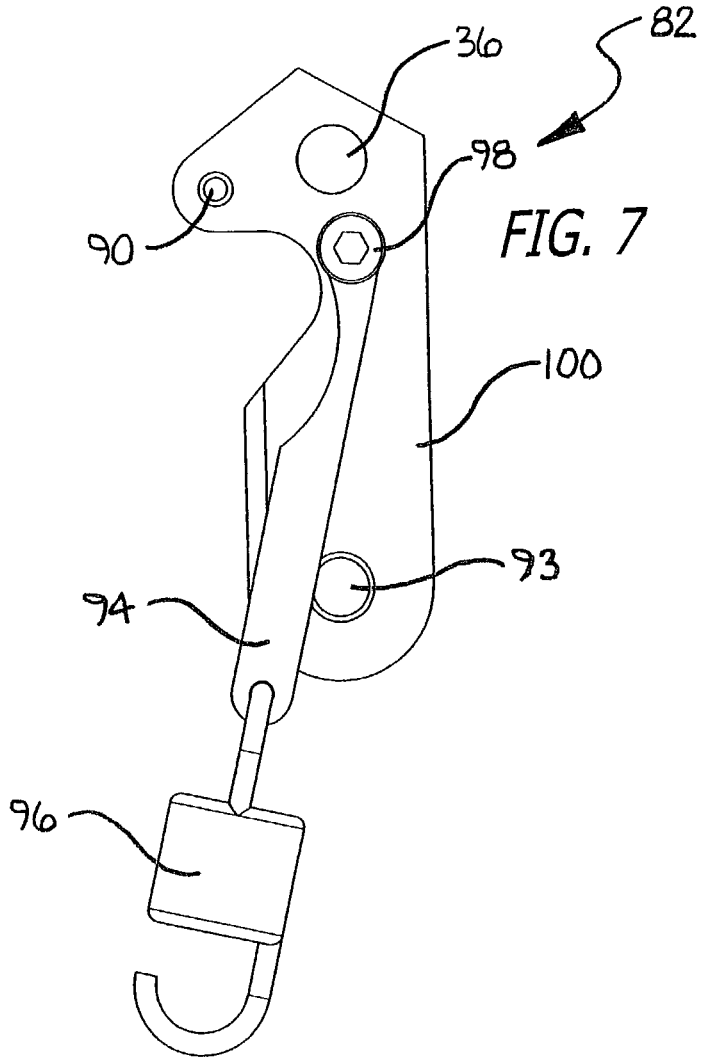
FIG. 7 is a side view showing one over-center mechanism for snap action of the sweep bar from the open position to the closed position and vice versa.

FIG. 7 shows the mechanism 82 for shifting the position of the sweep bar 36 in a snap action manner controlled by the over-center mechanism 82. In FIG. 7, the shaft 93 is fixed, and the linkage 94 connects the coil spring 96 to the pivot point 98. When the cam 86 (see FIG. 6) engages the cam follower pin 90 and pushes it in the upward direction, the support 100 for the sweep bar 36 shifts position so that the entire upper end of member 100 and the linkage 94 shifts to the right as shown in FIG. 7 and the sweep bar 36 is opened or shifted away from shaft and roller 78, as shown in FIG. 6.

Figure 8:
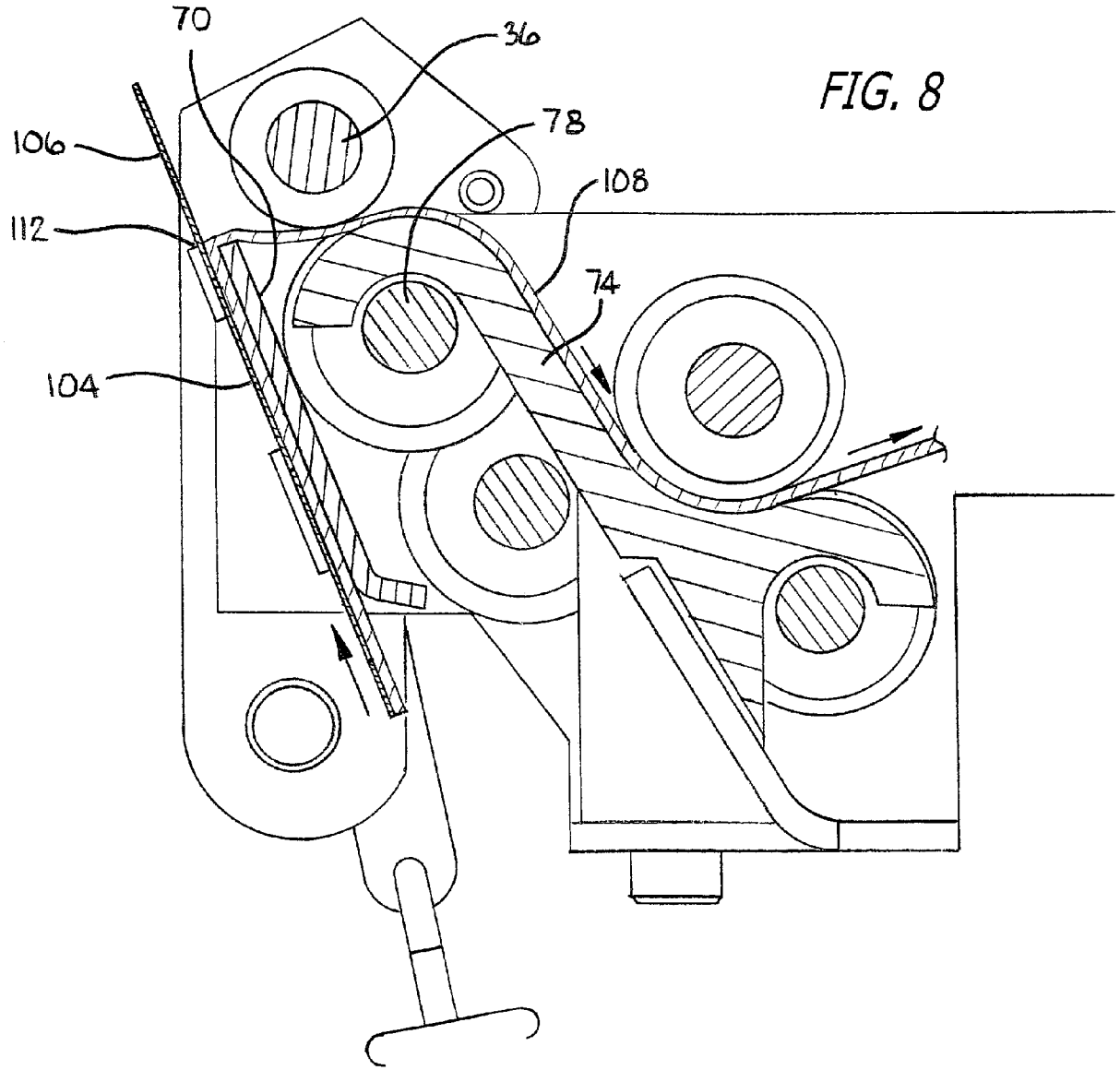
FIG. 8 is a diagrammatic showing of the paper path in the critical area where the labels are being dispensed, and where the backing sheet or liner is being decurled.

Referring to FIG. 8 of the drawings, the sweep bar 36 is shown in the closed position. The path of the label assembly and the liner is shown boldly, with the section of the label assembly with the labels still on the backing sheet being shown at reference number 104, with the label 106 being partially separated from the liner sheet which follows along the path 108. Also visible in FIG. 8 is the guide member 74 which was also shown in FIG. 5 of the drawings.

The label sheet including the labels passes along the peeling bar 70 up to a point 112 where it is shifted abruptly to the right so that the labels 106 are partially dispensed.

It is again noted, that at the beginning of the cycle when the label and the backing sheet assembly is initially fed into the dispenser, the upper edge of the label sheet beyond the first label extends above the point 112 with the sweep bar 36 in the open position. The dispenser has actuated the feed stepper motor by precisely the number of steps required for this initial positioning. Of course, at that time, the sweep bar 36 is in the open position as noted above. Then, by a camming action operating on the sweep bar 36, to move it to the right, the upper edge of the label sheet assembly is bent abruptly over the corner 112 of the peeling bar 70 and the leading edge is gripped by the feed roller 78. The feed stepper motors are then advanced to partially dispense the labels 106 as shown in FIG. 8, and the label sheets are maintained in this configuration until all of the labels in one row have been removed from their extended position as shown in FIGS. 1, 2 and 8 of the drawings. When the last label in a row of labels is removed, the sheet is advanced, and a new set of labels is partially dispensed as shown in FIGS. 1 and 8 of the drawings.

Figure 9:
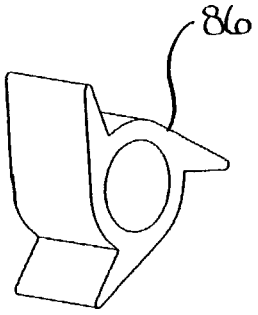
FIGS. 9 and 10 are views of two cams which are involved, respectively, in the over-center action of the sweep bar when the associated drive motor is actuated first in the forward direction and then in the reverse direction.
Figure 10:
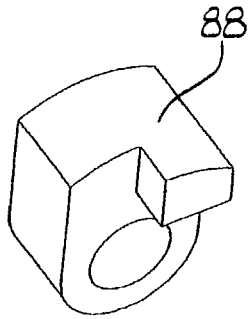

Referring now to FIGS. 9 and 10 of the drawings, these are individual perspective views of the cams 86 and 88 which operate to open and close the sweep bar 36, as explained hereinabove in connection with FIG. 6 of the drawings.

Figure 11:
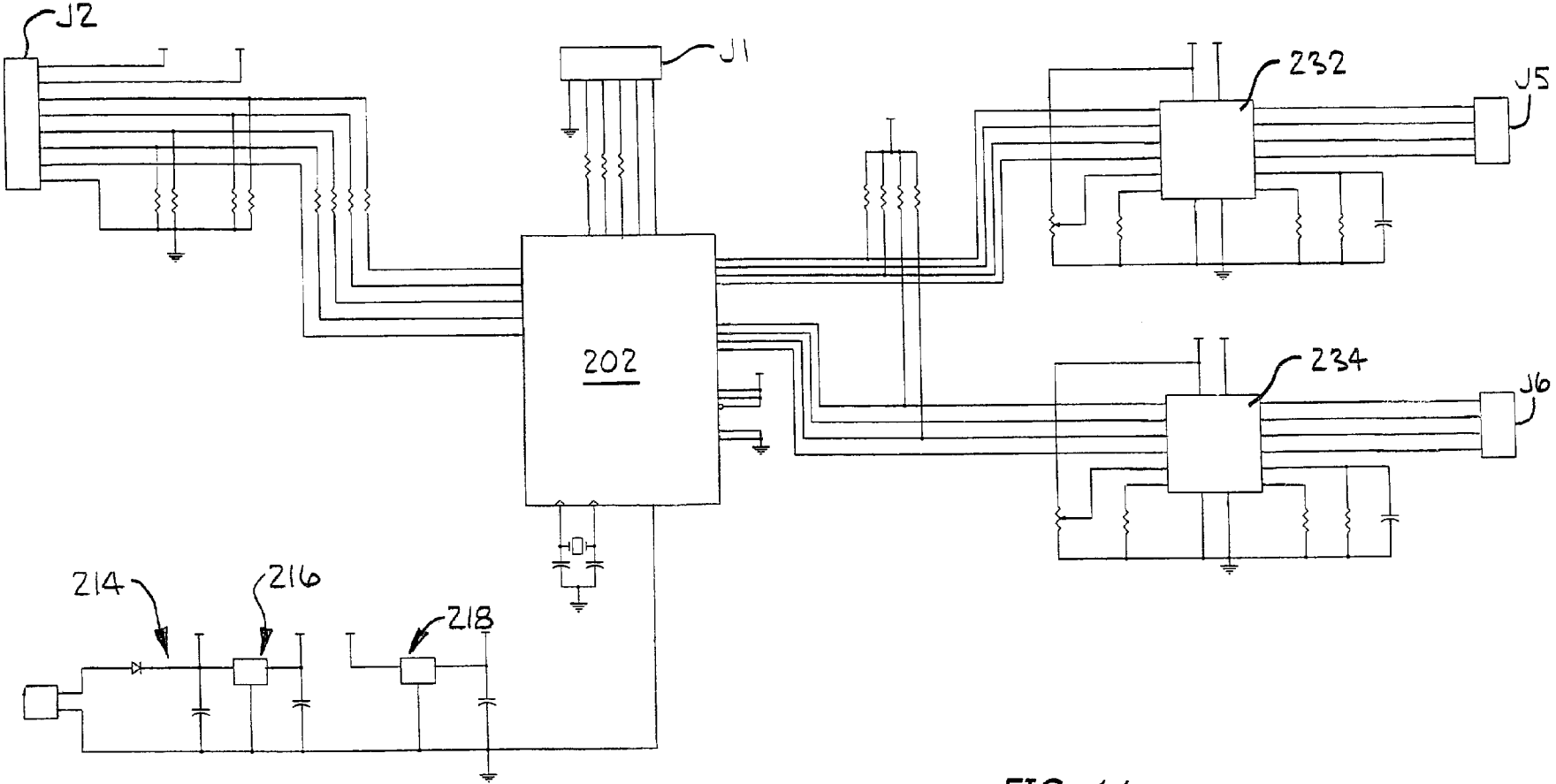
FIGS. 11, 12 and 13 are circuit diagrams of the electrical circuitry of the label dispenser system.
Figure 12:
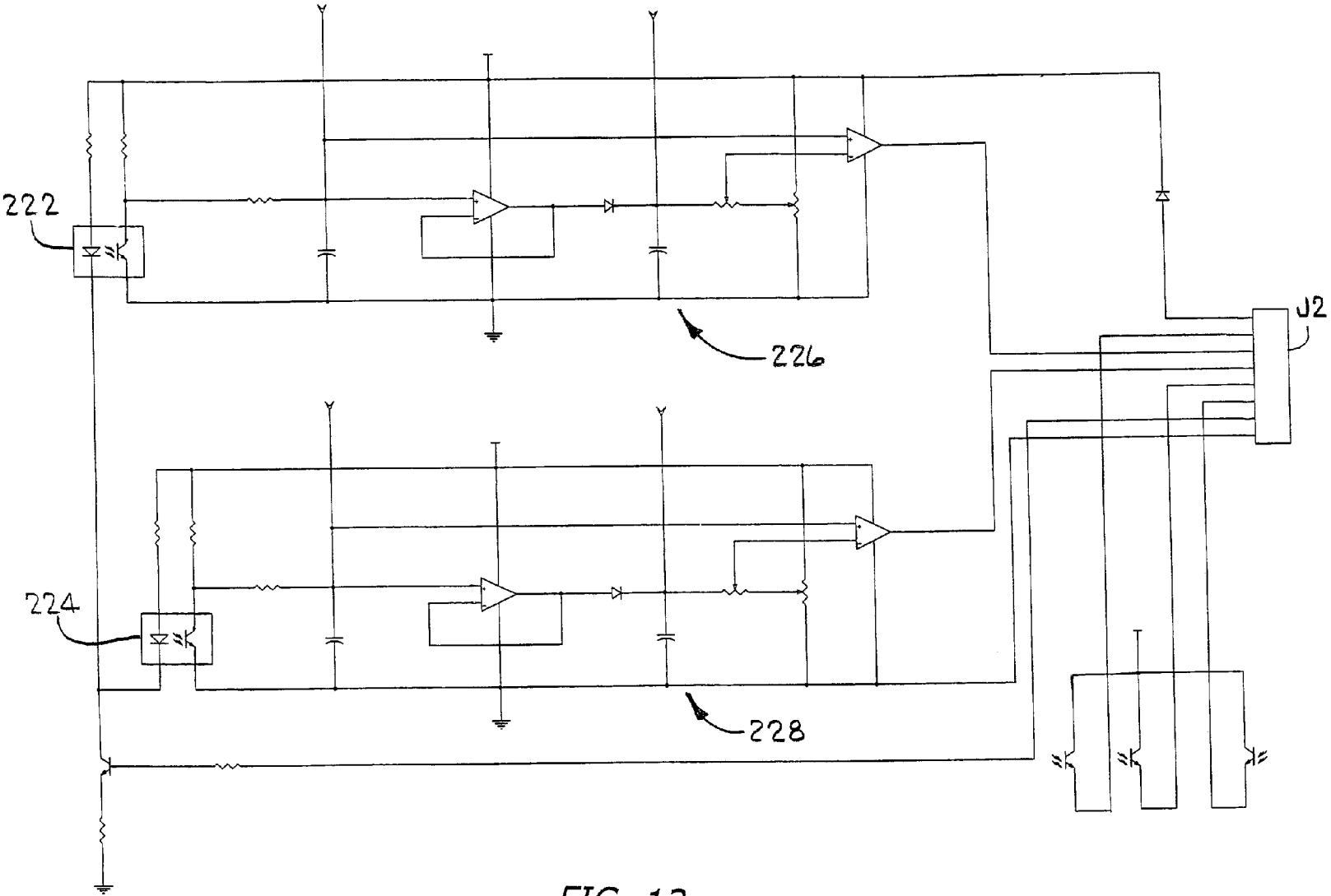
Figure 13:
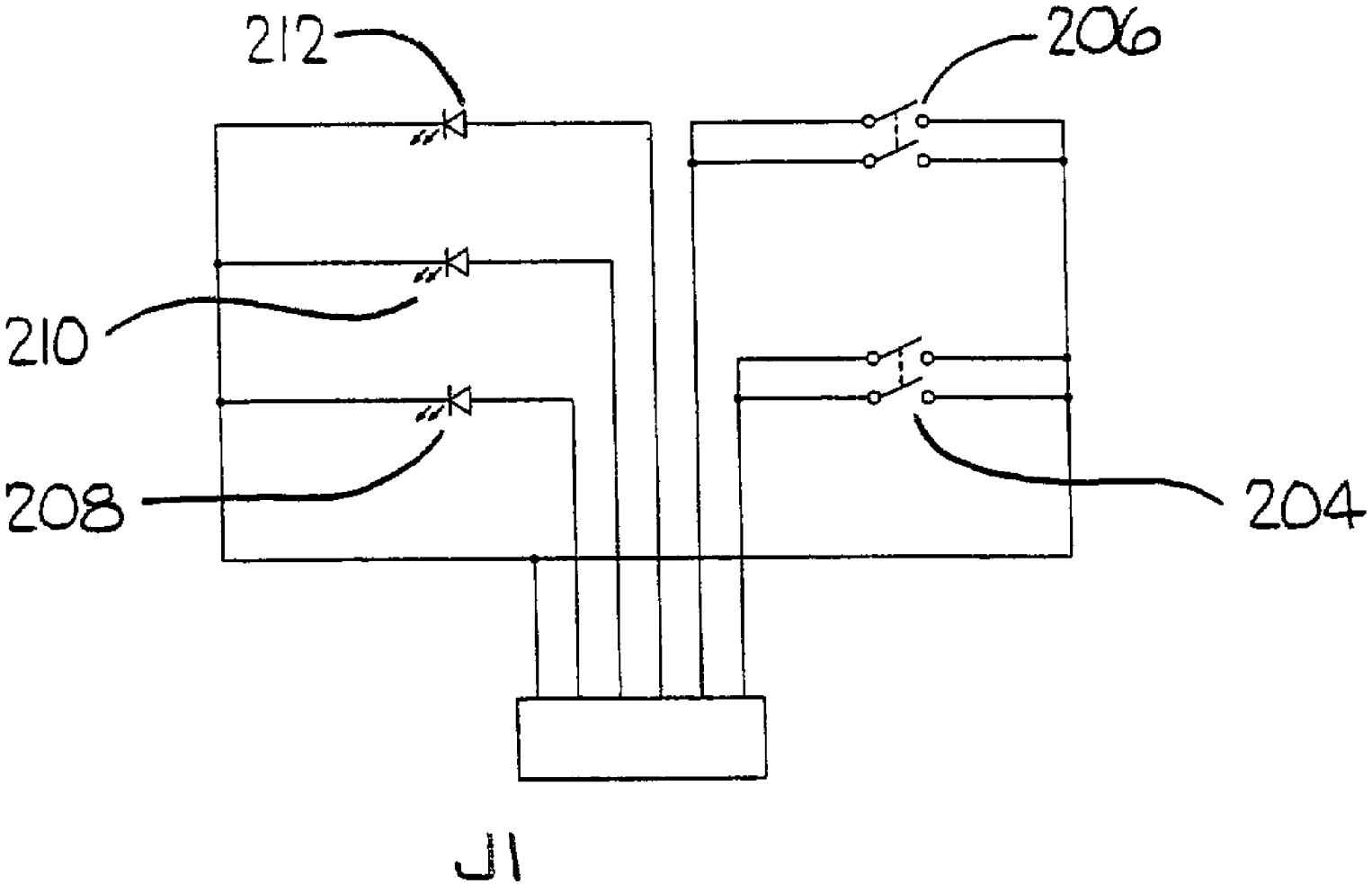

FIGS. 11, 12 and 13, which relate to the electrical circuitry for the label dispenser system will now be considered. Initially referring to FIG. 11, the microprocessor 202 is a central part of the system, and it includes both fixed program stored information, as well as temporary storage and data processing capabilities.

Referring momentarily to FIG. 13 of the drawings, the on/off or on/reset switch 204 and the eject switch 206 are coupled to the connector J1, which also appears in FIG. 11 as a mating portion of the connector, just above the microprocessor 202. In addition, the control or status signaling lights 208, 210 and 212 of FIG. 13 are also connected to the connector J1. In this regard the LED-208 is green, and is energized whenever the system is on. The yellow LED-210 comes on when the bar code on the label sheet assembly can not be read or is missing. Energization of the red error light emitting diode 212 indicates that there is a problem in the label dispensing system such as a paper jam, which must be corrected.

Other circuits included in the main circuit diagram of FIG. 11 include the power input circuitry 214 which provides 12 volt power input, and the voltage regulator circuits 216 and 218.

Referring now to FIG. 12 of the drawings, this is the bar code reader circuitry. There are two bar codes on each input sheet as indicated on FIG. 3, and the two corresponding sensors in FIG. 12 are sensors 222 and 224. Each of these sensors include a light emitting diode and a photo transistor pair, to detect the bar code images which are in the form of a series of spaced dark bars. The dark bars absorb light and prevent it from being reflected back to the photo transistors while the white areas between the dark lines readily reflect light from the LED's which is picked up by the photo transistors. Between the sensors 222, 224, and the connector J2 are circuits for filtering the input signals and for level detection to confirm the existence of particular bar code signals and separate them from slight imperfections in the paper or the like, which might otherwise produce a false signal. This circuitry is identified by reference numeral 226 for sensor 222 and by reference number 228 for sensor 224. The corresponding or mating connector J2 appears in the upper left hand portion of the circuit of FIG. 11.

At the upper right hand side of FIG. 11 are the connectors J5 and J6 which are connected, respectively, to the motors 64 and 68 as shown in FIG. 5 of the drawings. The circuits 232 and 234 are drivers for the stepper motors, taking the relatively low level signals from the microprocessor 202, and modifying them for energizing the stepper motors 64 and 68.

In the course of the foregoing description of the mechanical construction of the label dispenser and the electrical circuitry relating thereto, the mode of operation of the system has been described in some detail. However, for completeness, it is considered desirable to include in the following Program Table which sets forth the steps which take place in the course of the operation of the system.

PROGRAM TABLE

Program Steps Involving Operation of Dispenser

Step 1. Plug Into Power Socket Status:
(a) Green light on steady.
(b) Sweep bar open.
(c) Label sheet assemblies in input tray.
(d) Yellow and Red signal lights off.

Step 2. Actuate "On-Reset" Switch
(a) Label sheet picker actuated.
(b) Sheets fed forward.
(c) Front edge of sheets sensed by bar code readers 48–50.
(d) Bar codes read by bar code readers 48–50.
(e) Label sheets fed forward until leading edge of sheet is even with sweep bar, changing state of sensors 51.
(f) Sweep bar actuated to bend top of backing sheet over the peeling bar.
(g) Label sheet advanced so that labels extend upward from dispenser (see FIG. 1).

Step 3. All Labels Removed, so that the State of All Sensors 51 Are Changed.
(a) Sheet is advanced by a distance equal to the space between the top edge of successive labels, making a new row of labels available.

Step 4. All Labels Removed, so that the States of All Sensors 51 Are Changed.
(a) Sheet is advanced by a distance equal to the distance between the top edge of successive labels, making a new row of labels available.

Step 5. Sheet is Advanced, and No Change of State of Sensors 51 Occurs, Indicating that All the Labels on the Sheet Have Been Dispensed.
(a) Backing sheet is continuously fed forward into used liner waste tray.
(b) New label sheet fed into dispenser, and process is repeated.

Other program steps include the following:
1. If the on/reset switch is actuated and there are no label sheets in the input tray; or if there is a paper jam, the red signal light 44 will be turned on.
2. If the front door or panel 32 is open, the red signal light 44 will flash.
3. If a sheet is fed through the dispenser, and if a meaningful bar code is not read, the yellow light 46 will turn on. Under these conditions, the sweep bar is not actuated and the label sheet is ejected at the top of the dispenser adjacent the sweep bar.
4. If the "eject" switch 40 is depressed while there is a label sheet in the dispenser, and exposed labels are then deleted, the green on/off light flashes, the sweep bar is opened, and the sheet will be ejected at the top of the dispenser adjacent the sweep bar.
5. The label sensors 51–53 identify the leading edge of labels 28, see FIG. 1, and advance the label sheets by the proper distance to partially dispense labels. This avoids problems which might otherwise arise by slight slippage of the sheets as they are advanced.

Figure 14:
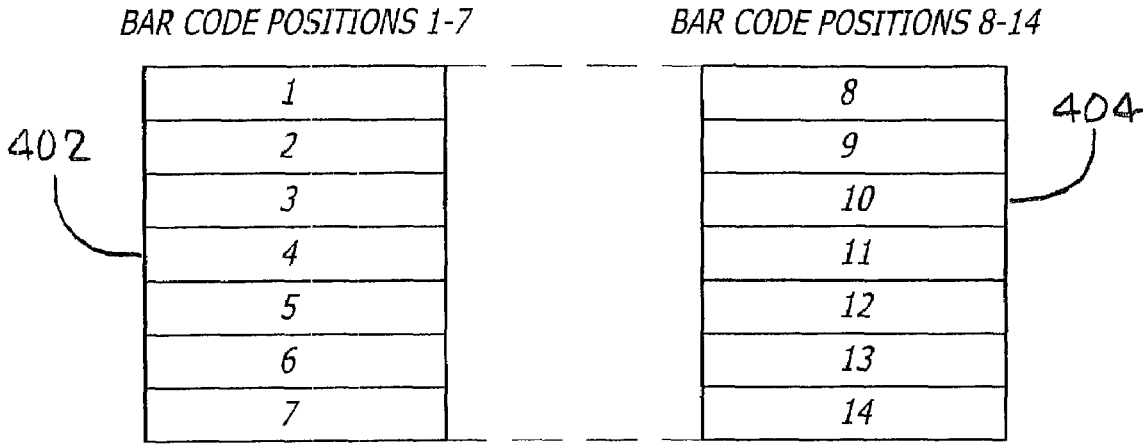
FIG. 14 is a diagram of one bar coding pattern which may be employed in the implementation of one aspect of the invention.

As mentioned above, each sheet includes bar coded information which may include (1) the height of the labels, (2) the distance of the first label from the edge of the label sheet assembly to the top of the first label, and (3) the size of the face stock or matrix (if any) between labels. In view of the desirability of having the labels fairly close to the edge of the sheet, the bar code is divided into two bar codes, as generally indicated by the two bar code diagrams 402 and 404 as shown in FIG. 14 of the drawings. With each bar code space being equal to 0.040 inch in height, the total height of each bar code is about 0.280 inch.

In one exemplary embodiment, the first seven bar code positions 1 through 7 are employed to designate the height of the label from 0000001 for 1/16 inch, to 1011010, denoting a 5 inch high label with each code including seven bits. The label height codes may involve sixteenths of an inch, and may include other desired labels widths such as 1/3 or 2/3 or an inch.

The next four bar code positions designated 8 through 11 represent the distance from the edge of the paper to the top of the first label. The selected distances and codes are set forth in the following Table No. I:

TABLE NO. I

| Top Edge (Inches) | Bar Code Representation |
|---|---|
| 3/8 | 0001 |
| 1/2 | 0011 |
| 5/8 | 0101 |
| 3/4 | 0111 |
| 7/8 | 1001 |
| 1 | 1011 |
| 1 1/8 | 1101 |
| 1 1/4 | 1111 |

TABLE NO. II

| Webbing Size (Inches) | Bar Code Representation |
|---|---|
| 0 | 100 |
| 1/8 | 101 |
| 1/4 | 110 |
| 3/8 | 111 |

Bar Code Position No. 8 is shown at the far right, in Table No. I, and it may be seen that this is always a "1", represented in the bar code by a dark line (while a "0" is represented by the absence of a line).

The final three bar code positions designated 12 describe the size of the face stock or matrix (if any) between successive labels. In Table No. II, the bar code position No. 14 is in the far left position of each bar code representation and is always a "1".

Accordingly, with bar code positions 8 and 14 always a "1", represented by a dark line, a framework is established for reading the other "meaningful" binary digits 1 through 7, and 9 through 13.

Figure 15:
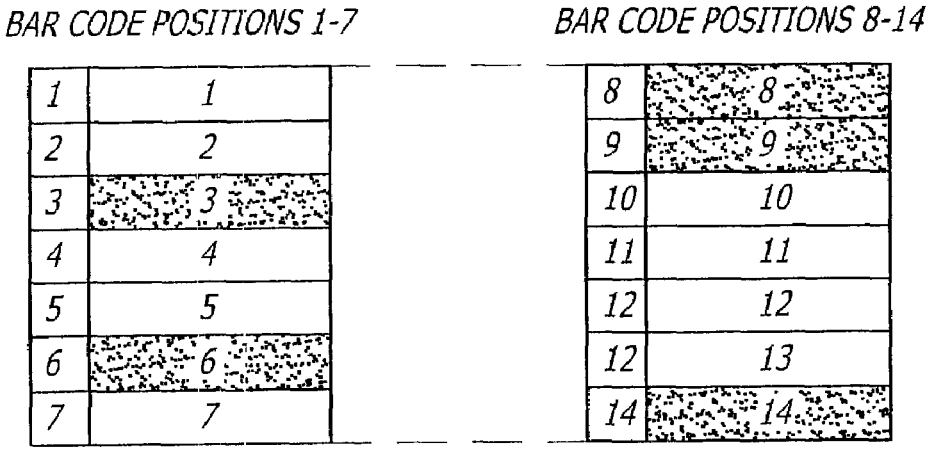
FIG. 15 shows one specific code pattern.

FIG. 15 represents a typical bar code pattern. Considering first, code positions 8 through 11, as set forth at 404 in FIG. 14 and in the right hand pattern in FIG. 15, the binary pattern is "0011", indicating, by reference to Table No. I, that there is ½ inch space from the leading edge of the paper to the first label. Considering next, code positions 12, 13 and 14, the binary code is "100" indicating, by reference to Table No. II, that there is no space between labels, but that the labels immediately abut one another. Note that in each case the lower bar code position is to the right, and the higher bar code position is to the left.

Referring now to code positions 1 through 7, the code is "0010010" which has been assigned to represent labels which are one inch in height.

It may be noted again that with code positions 8 and 14 always a binary "1", represented by a line, a framework is established for reading the other 12 binary code positions. In addition, either the edge of the label sheet assembly, or the dark line in code position 8 or 14 may be employed to locate the position of the leading edge of the label sheets in the label dispenser, for accurate advancing of the sheet by the stepper motors.

It is further noted that the two sets of bar codes as shown in FIG. 15 are preferably spaced fairly close to one another so that bar code positions 1–7 may be accurately read, using bar code positions 8 and 14 to establish a "framework" for reading both of the two bar codes.

It is also noted that the bar codes may be provided on two ends of the label sheet assemblies, as shown at 62 and 62' in FIG. 13, if the label sheets are to be fed in either direction. In this case, of course, the left to right positions of the two bar codes are reversed, so that the same signals are read by the readers, with the label sheets being fed with either end leading.

It is to be understood that the foregoing detailed description relates to one specific illustrative embodiment of the invention; and that various changes and modifications may be made without departing from the spirit and scope of the invention. Thus, by way of example and not of limitation, the machine readable coding may be in the form of a magnetic code or reflecting surface on the paper rather than the bar codes as disclosed. In addition, the label sheet layout may be defined by other information, such as the space between the initial edge of successive labels; and label sheets of varying lengths may be defined in the bar codes. The mechanical construction and reverse motor coupling could be implemented by equivalent mechanical mechanisms. It is also noted that the dispenser may operate to sense the presence or absence of labels at the instant after the sheet has been advanced, thereby determining whether or not the last row of labels has been dispensed. Using this information, if all of the labels have been dispensed, the dispenser output feed rollers are operated to route the backing sheet to the output tray. Also, 14 inch label sheet assemblies may be handled as well as 11 inch sheets, without explicit coded information on the sheets indicating sheet size or the number of label rows being provided. Regarding coded information, it may appear only on one end of the label sheets instead of on both ends, and this coded end of the label sheet assembly would then be the leading edge of the label sheet assembly. In addition, the coded information may include other information about the construction of the label sheet assemblies such as the quality of the assemblies, and other factors to insure that the sheet assemblies are compatible with and will not jam the dispenser. Concerning the cam and cam follower mechanism for operating the sweep bar, other mechanical mechanisms such as a crank and rocker, or other Grashof type mechanisms may be employed. Accordingly, the present invention is not limited to the precise parameters described in detailed hereinabove.

We claim:

1. A versatile label dispenser system comprising:

a label sheet assembly feeding apparatus, for label sheet assemblies which have a release coated backing sheet, face stock with labels die cut through the face stock; and pressure sensitive adhesive between the face stock and the backing sheet;

a peeling blade for separating the labels from the backing sheet;

a movable sweep bar for selectively deflecting the backing sheet over the peeling blade in a predetermined direction, with the labels partially separated from the backing sheet and extending outwardly therefrom;

an input tray for holding a stack of label sheet assemblies directed toward the sheet feeding apparatus;

a decurling structure for bending the sheets in a direction opposite from said predetermined direction, an output tray adjacent said input tray for receiving used substantially flat backing sheets;

said label sheet assemblies having machine readable coded information thereon indicating the layout of labels on the label sheet assemblies; and electrical circuitry for controlling said sheet feeding apparatus to advance said label sheet assemblies in accordance with information read from said coded information.

2. A versatile label dispenser system as defined in claim 1 wherein said coded information is in the form of bar code information.

3. A versatile label dispenser system as defined in claim 2 wherein said bar code information is in the form of two closely spaced bar codes, to insure reliability and to minimize the space required for the bar codes.

4. A versatile label dispenser system as defined in claim 1 wherein said label sheet assemblies are loaded with the backing sheet facing upward and toward said sheet feeding apparatus.

5. A versatile label dispenser system as defined in claim 1 wherein said sweep bar is mounted on a pair of over-center snap action actuator members.

6. A versatile label dispenser system as defined in claim 5 wherein cams and cam followers are provided for operating said snap action actuator members.

7. A versatile label dispenser system as defined in claim 6 wherein a reversible motor is provided for operating one of said cams to open said sweep bar by actuation of said motor in one direction, and for operating the other of said cams to close said sweep bar by operating said motor in the other direction.

8. A versatile label dispenser system as defined in claim 7 wherein said backing sheet is fed toward said output tray by further operation of said motor in said other direction.

9. A versatile label sheet dispenser as defined in claim 1 wherein a plurality of dispense sensors are provided for sensing the presence of the labels which are partially separated from the backing sheet; and wherein said electrical circuitry actuates said sheet feeding apparatus to incrementally advance said sheet assembly by the spacing between the leading edges of successive labels, when said dispense sensors indicate that the partially separated labels have been removed.

10. A versatile label sheet dispenser as defined in claim 1 wherein an input sensing apparatus is provided for sensing said coded information and for sensing the edge of said sheet assemblies.

11. A versatile label dispenser system comprising:

a label sheet assembly feeding apparatus, for label sheet assemblies which have a release coated backing sheet, face stock with labels die cut through the face stock; and pressure sensitive adhesive between the face stock and the backing sheet;

a peeling blade for partially separating the labels from the backing sheet with the labels partially separated from the backing sheet and extending outward from said dispenser system;

said label sheet assemblies having machine readable coded information relating to the construction of the label sheet assemblies; and electrical circuitry for sensing said coded information and controlling said sheet feeding apparatus to advance said label sheet assemblies in accordance with said coded information;

wherein said coded information is in the form of bar code information.

12. A versatile label dispenser system as defined in claim 11 wherein said bar code information is in the form of two closely spaced bar codes, to insure reliability and to minimize the space required for said bar code information.

13. A versatile label dispenser system comprising:

a label sheet assembly feeding apparatus, for label sheet assemblies which have a release coated backing sheet, face stock with labels die cut through the face stock; and pressure sensitive adhesive between the face stock and the backing sheet;

a peeling blade for partially separating the labels from the backing sheet with the labels partially separated from the backing sheet and extending outward from said dispenser system;

said label sheet assemblies having machine readable coded information relating to the construction of the label sheet assemblies; and electrical circuitry for sensing said coded information and controlling said sheet feeding apparatus to advance said label sheet assemblies in accordance with said coded information;

said label dispenser system further including sensors for sensing the presence of said partially dispensed labels, and for sensing the leading edges thereof, and said circuitry thereafter advancing said sheets by the distance between the leading edges of successive labels.

* * * * *